US005811367A

United States Patent [19]

Sheiham

[11] Patent Number: 5,811,367

[45] Date of Patent: Sep. 22, 1998

[54] PRESSURE-SENSITIVE COPYING MATERIAL

[75] Inventor: Ivan Sheiham, Marlow, United Kingdom

[73] Assignee: The Wiggins Teape Group Limited, United Kingdom

[21] Appl. No.: 740,324

[22] Filed: Oct. 28, 1996

[30] Foreign Application Priority Data

Oct. 31, 1995 [GB] United Kingdom ..... 9522233

[51] Int. Cl.[6] ..... B41M 5/155

[52] U.S. Cl. ..... 503/201; 503/215; 503/218; 503/220

[58] Field of Search ..... 503/215, 218, 503/201, 220

[56] References Cited

U.S. PATENT DOCUMENTS

| | | | |
|---|---|---|---|
| 2,800,457 | 7/1957 | Green | 252/316 |
| 2,800,458 | 7/1957 | Green | 252/316 |
| 3,024,927 | 3/1962 | Quayle | 214/131 |
| 3,041,289 | 6/1962 | Katchen et al. | 252/316 |
| 3,672,935 | 6/1972 | Miller et al. | 118/36.8 |
| 3,753,761 | 8/1973 | Sugihara et al. | 117/36.2 |
| 4,001,140 | 1/1977 | Foris et al. | 252/316 |
| 4,100,103 | 7/1978 | Foris et al. | 252/316 |
| 4,105,823 | 8/1978 | Hasler et al. | 428/307 |
| 4,181,639 | 1/1980 | Bomer et al. | 260/29.6 WB |
| 4,253,682 | 3/1981 | Baatz et al. | 282/27.5 |
| 4,379,071 | 4/1983 | Schnöring et al. | 252/316 |
| 4,396,670 | 8/1983 | Sinclair | 428/321.5 |
| 4,412,959 | 11/1983 | Wegner et al. | 264/4.1 |
| 4,428,983 | 1/1984 | Nehen et al. | 427/213.34 |
| 4,598,150 | 7/1986 | Fujisaki et al. | 546/152 |
| 4,612,254 | 9/1986 | Ginter et al. | 428/531 |
| 4,625,027 | 11/1986 | Zink et al. | 284/129 |
| 4,668,966 | 5/1987 | Zink et al. | 503/218 |
| 4,705,775 | 11/1987 | Zink et al. | 503/218 |
| 5,308,824 | 5/1994 | Matsushita et al. | 503/226 |

FOREIGN PATENT DOCUMENTS

| | | | |
|---|---|---|---|
| 109930 | 5/1984 | European Pat. Off. | 503/218 |
| 0275107 | 7/1988 | European Pat. Off. | 503/216 |
| 0226367 | 2/1990 | European Pat. Off. | 428/207 |
| 0391542 | 10/1990 | European Pat. Off. | 503/217 |
| 0491487 | 6/1992 | European Pat. Off. | 503/207 |
| 0503443 | 9/1992 | European Pat. Off. | 428/480 |
| 0520639 | 12/1992 | European Pat. Off. | 503/213 |
| 0521474 | 1/1993 | European Pat. Off. | 503/216 |
| 0573210 | 12/1993 | European Pat. Off. | 503/210 |
| 0576176 | 12/1993 | European Pat. Off. | 503/207 |
| 0593192 | 4/1994 | European Pat. Off. | 503/213 |
| 0356199 | 5/1994 | European Pat. Off. | 503/221 |
| 4110354 | 10/1991 | Germany | 503/216 |
| 1211393 | 11/1970 | United Kingdom | 503/221 |
| 1374049 | 11/1974 | United Kingdom | 503/221 |
| 1389716 | 4/1975 | United Kingdom | 503/220 |

OTHER PUBLICATIONS

Patent Abstracts of Japan, vol. 12, No. 164 May 18, 1988.

Patent Abstracts of Japan, vol. 14, No. 140 Mar. 16, 1990.

*Primary Examiner*—Bruce H. Hess

*Attorney, Agent, or Firm*—Burns, Doane, Swecker & Mathis, L.L.P.

[57] ABSTRACT

Pressure-sensitive copying material comprises a substrate carrying isolated droplets of an oil solution of chromogenic material confined within respective pressure-rupturable barriers. The chromogenic material develops a colour other than blue or black on contact with colour developer and comprises a component which is fluorescent. This enables the authenticity of the copying material to be verified by irradiation with ultra-violet light to produce fluorescence. The fluorescent material can be, for example 2,2-bis(4-{2-[4-diethylaminophenyl]-quinazolin-4-yloxy}phenyl) propane or 1-(3-methoxy-4-dodecyloxyphenyl)-2-(2'-quinolyl) ethylene. Non-fluorescent chromogenic material(s) are preferably used in combination with the fluorescent chromogenic material(s).

13 Claims, No Drawings

PRESSURE-SENSITIVE COPYING MATERIAL

This invention relates to pressure-sensitive copying material, also known as carbonless copying paper.

Pressure-sensitive copying material is well-known and is widely used in the production of business forms sets. Various types of pressure-sensitive copying material are known, of which the most widely used is the transfer type. A business forms set using the transfer type of pressure-sensitive copying material comprises an upper sheet (usually known as a "CB" sheet) coated on its lower surface with microcapsules containing a solution in an oil solvent or solvent composition of at least one chromogenic material (alternatively termed a colour former) and a lower sheet (usually known as a "CF" sheet) coated on its upper surface with a colour developer composition. If more than one copy is required, one or more intermediate sheets (usually known as "CFB" sheets) are provided, each of which is coated on its lower surface with microcapsules and on its upper surface with colour developer composition. Imaging pressure exerted on the sheets by writing, typing or impact printing (e.g. dot-matrix or daisy-wheel printing) ruptures the microcapsules, thereby releasing or transferring chromogenic material solution on to the colour developer composition and giving rise to a chemical reaction which develops the colour of the chromogenic material and so produces a copy image.

In a variant of the above-described arrangement, the solution of chromogenic material may be present as isolated droplets in a continuous pressure-rupturable matrix instead of being contained within discrete pressure-rupturable microcapsules.

In another type of pressure-sensitive copying system, usually known as a self-contained or autogenous system, microcapsules and colour developing co-reactant material are coated onto the same surface of a sheet, and writing or typing on a sheet placed above the thus-coated sheet causes the microcapsules to rupture and release the solution of chromogenic material, which then reacts with the colour developing material on the sheet to produce a coloured image.

Business forms sets utilising pressure-sensitive copying materials can be put to a wide variety of uses in, for example, business, commerce, and national and local government administration. For some of the many actual or potential uses of these products, it is desirable that at least one of the sheets making up the set should incorporate a security feature of some kind, in order that its authenticity can be verified. This is the case, for example, if one of the sheets of the set is to be used as proof of entitlement to a payment, for example an unemployment, sickness or pension benefit or a refund of tax or customs duty. Such payments are often made on presentation of appropriate documentation to a cashier. It is desirable that the cashier should be able to verify the authenticity of the documentation presented before payment is made. There is therefore a need for pressure-sensitive copying material incorporating a security feature by means of which its authenticity can be verified.

In principle, a security feature could be provided in a business forms set by the use of a conventional security paper as the base paper for subsequent coating with microcapsules and colour developer composition. Such security paper, an example of which is disclosed in our European Patent Application No. 391542A, can be authenticated by the use of an authenticating reagent which produces a colour change on application to the genuine security paper. In practice however, such security papers are normally too expensive for use in business forms sets, except for specialities such as cheques.

It is an object of the present invention to provide pressure-sensitive copying material incorporating a cost-effective and readily-verifiable security feature.

According to a first aspect of the invention, there is provided pressure-sensitive copying material comprising a substrate carrying isolated droplets of an oil solution of chromogenic material, said droplets being confined within respective pressure-rupturable barriers, characterised in that said chromogenic material:

(a) develops a colour other than blue or black on contact with colour developer in use of the copying material; and (b) comprises a component which is fluorescent, whereby the authenticity of the copying material can be verified by irradiation with ultra-violet light to produce fluorescence.

In a second aspect, the present invention provides a business forms set comprising pressure-sensitive copying material as just defined.

The substrate is preferably of paper, and preferably is coloured rather than white in order that the fluorescent effect shows up better and is not susceptible to partial masking by optical brightening agents often present in white papers.

The pressure-rupturable barrier within which each droplet of chromogenic material solution is confined is typically the wall of a microcapsule. Alternatively, the pressure-rupturable barrier can be part of a continuous pressure-rupturable matrix as referred to earlier.

The pressure-sensitive copying material can take the form of a CB, CFB or self-contained product, all as described earlier.

The present pressure-sensitive copying material may be used not only for applications in which the material provides proof of entitlement to a payment as described earlier but also for other applications where security is important. One such application is tickets for sporting or theatre events or the like or for travel. Another such application is documents providing evidence of a right to enter a restricted area or territory, where entry is granted on presentation of documentary authority, for example to a gatekeeper or receptionist or to a border or immigration official.

Chromogenic materials which are fluorescent are known in themselves. Bisquinazolines of the kind disclosed in U.S. Pat. No. 4,625,027 are examples of such fluorescent chromogenic materials, and are suitable for use in the present pressure-sensitive copying material. They generate a yellow or orange hue on colour development and have the general formula (I) shown below:

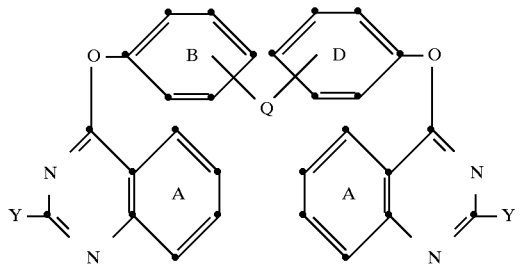

(I)

wherein

Q is a direct bond, an aliphatic or cycloaliphatic hydrocarbon radical containing not more than 8 carbon atoms, or is —CO—, —S— or —$SO_2$—, and Y is the radical of a couplable compound, and the rings A, B and D may each independently be unsubstituted or substituted by cyano, nitro, halogen, lower alkyl, phenyl, benzyl, lower alkoxy or lower alkoxycarbonyl Couplable compounds of which Y is a radical may be unsubstituted or N-monosubstituted or N,N-disubstituted anilines or naphthylamines, N-unsubstituted or N-substituted indoles, indolines, carbazoles, tetrahydrocarbazoles, dihydroquinolines, tetrahydroquinolines, dibenzylimides, benzomorpholines or phenylpyrazolines. Preferably, Y is the radical of a couplable N,N-disubstituted aniline or an N-substituted tetrahydroquinoline.

The compound disclosed in Example 2 of U.S. Pat. No. 4,625,027, namely 2,2-bis(4-{2-[4-diethylaminophenyl]-quinazolin-4-yloxy}phenyl) propane, is of particular interest and utility, since it has been commercialised by Ciba-Geigy A. G. under the name PERGASCRIPT Yellow I-3R (PERGASCRIPT is a trade mark). This compound gives a yellow hue on development and has the formula shown below:

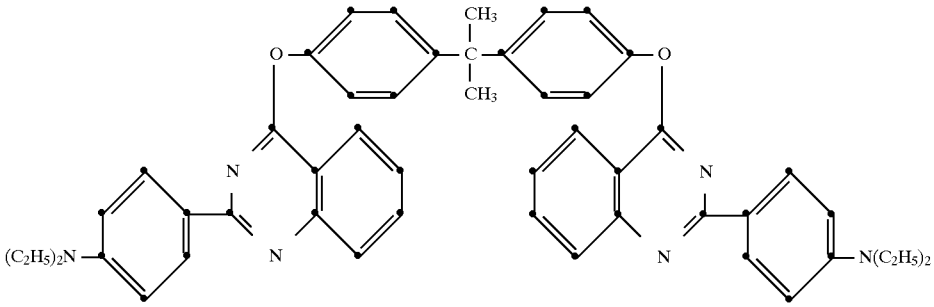

(II)

Other examples of fluorescent chromogenic materials usable in the present pressure-sensitive copying material are as follows:

(i) 1-(3-methoxy-4-dodecyloxyphenyl)-2-(2'-quinolyl) ethylene

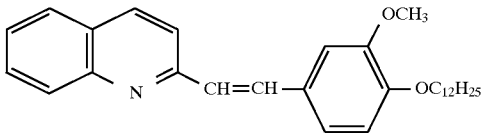

(III)

The synthesis of this compound is disclosed in Example 2 of U.S. Pat. No. 4,598,150. It provides a yellow hue on development.

(ii) 3,6-bis(diethylamino)fluoran-γ-(4'-nitro)-anilino lactam ("Pink DCF", available from Hodogaya Chemical Co. Ltd, Kawasaki, Japan)

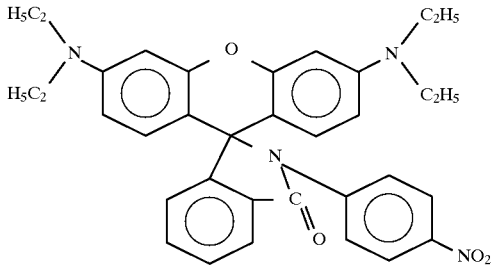

(IV)

(iii) 3,6-bis(diethylamino)flouran-γ-anilino lactam ("Rhodamine lactam", available from Hodogaya Chemical Co. Ltd.)

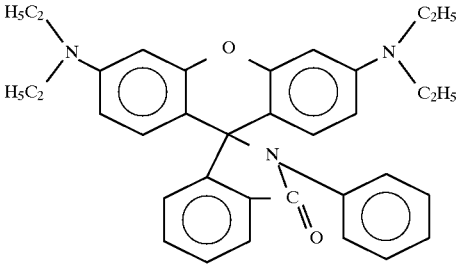

(V)

(iv) 2-bromo-3-methyl-6 N,N di-n-butylaminoflouran ("Vermilion B2" also known as "Vermilion DCF", available from Hodogaya Chemical Co. Ltd.). This compound is the subject of Example 1 of European Patent No. 356199B.

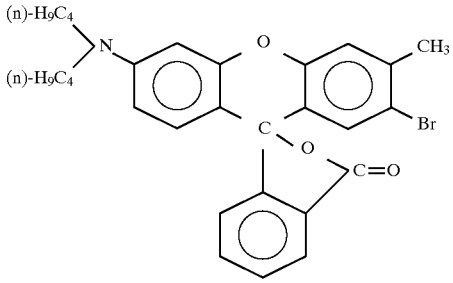

(VI)

In use of pressure-sensitive copying materials in business forms sets, it is often desirable to desensitize selected areas of a CF sheet, or the CF surface of a CFB sheet, in order to prevent image formation in those selected areas. This enables certain of the information typed or printed on the top sheet of the set to be kept secret from a recipient of a lower sheet of the set when the various sheets of the set are distributed. Whilst this system works well in relation to visual image formation, secrecy cannot be fully maintained if one or more of the chromogenic materials used is fluorescent. This is because the desensitization of the colour developer prevents rapid development of the colour of the chromogenic material, which therefore retains its fluorescence for a period of time, typically several days at least. Consequently, an image which was intended to be kept secret can be read with the aid of a UV lamp which reveals the fluorescence. The present invention by contrast turns this drawback to advantage.

At least some of the fluorescent chromogenic materials identified above are or have been used commercially by certain manufacturers of conventional pressure-sensitive copying materials producing a blue or black image. Consequently, use of a fluorescent chromogenic material cannot, of itself, provide complete security. Thus in order to distinguish the present copying material from all prior art products, it is necessary to ensure that the image colour is different from those of prior art products in which a fluorescent chromogenic material happens to have been used. In practice, this means that the image colour must not be blue or black.

In practising the invention, the fluorescent chromogenic material will generally be used in combination with at least one other chromogenic material in order to provide the desired image hue or intensity. For example, a yellow hue as provided by the compound of formula (II) is not very satisfactory on its own, as it does not afford sufficient contrast with the paper and therefore does not show up sufficiently well to the human eye, particularly when viewed in artificial light from an incandescent filament lamp. However, a satisfactory image hue and intensity can be obtained if the fluorescent chromogenic material is used in combination with a red or a magenta chromogenic material, for example 3,3-bis(1-n-octyl-2-methylindol-3-yl) phthalide. This is disclosed in British Patent No. 1389716 (sixth compound in Table 1, made by the synthetic route of Example 1) and is commercially available from Ciba-Geigy A. G. under the name PERGASCRIPT Red I-6B. The magenta hue from this material combines with the yellow hue from the compound of formula (II) to form a distinctive red/orange hue which is easily distinguished from the image colour of most if not all pressure-sensitive copying materials currently on the market. This in itself adds to the security provided by the fluorescence of the compound of formula (II).

The concentration of the fluorescent chromogenic material solution can be chosen in accordance with the level of fluorescence required in the final product, but we have found that a concentration in the range 0.25% to 1% w/w is generally satisfactory. The concentration of complementary non-fluorescent chromogenic material(s) can vary widely in accordance with the image hue and intensity desired, but typically is in the range 0.5% to 5% w/w. Both of the ranges just quoted are given by way of example only and are not to be regarded as limiting. Further guidance as to suitable formulations is obtainable from the Examples given later. Where the fluorescent chromogenic material produces a yellow image hue and it is used in combination with a red- or magenta-developing chromogenic material, the latter is preferably used in a concentration of from 1 to 3% w/w, and the weight ratio of red- or magenta-developing chromogenic material to yellow-developing fluorescent chromogenic material is preferably from about 4:1 to about 6:1. A particularly preferred chromogenic material combination comprises 0.75% by weight of chromogenic material of formula (II) and 3% by weight of 3,3-bis(1-n-octyl-2-methylinolol-3-yl) phthalide.

In other respects, the present pressure-sensitive copying material can be conventional.

The microcapsules may be produced by coacervation of gelatin and one or more other polymers, e.g. as described in U.S. Pat. Nos. 2,800,457; 2,800,458; or 3,041,289; or by in situ polymerisation of polymer precursor material, e.g. as described in U.S. Pat. Nos. 4,001,140; 4,100,103; 4,105,823 and 4,396,670, or by interfacial techniques such as disclosed in U.S. Pat. Nos. 4,379,071; 4,428,983; 4,412,959; 4,253,682; or 4,181,639.

The chromogen-containing microcapsules, once produced, are formulated into a coating composition with a suitable binder, for example starch or a starch/carboxymethylcellulose mixture, and a particulate agent (or "stilt material") for protecting the microcapsules against premature microcapsule rupture. The stilt material may be, for example, wheatstarch particles or ground cellulose fibre floc or a mixture of these. The resulting coating composition is then applied by conventional coating techniques, for example metering roll coating or air knife coating.

The thickness and grammage of the base paper used in the present pressure-sensitive copying paper can be as conventional for this type of paper, for example the thickness may be about 60 to 90 microns and the grammage about 35 to 50 $gm^{-2}$, or higher, say up to about 100 $gm^{-2}$, or even more. This grammage depends to some extent on whether the final paper is for CB or CFB use. The higher grammages just quoted are normally applicable only to speciality CB papers. The base paper may be acid-sized (typically rosin-alum sized) or neutral- or alkaline sized, for example with alkyl ketene dimer or succinic anhydride sizes. If neutral- or alkaline-sizing is used, the paper is preferably treated with an agent for counteracting discolouration, as disclosed more fully in our European Patent Application No. 576176A or No. 491487A.

The solvent used to dissolve the chromogenic materials can be chosen, for example, from partially hydrogenated terphenyls, alkylnaphthalenes, diarylmethanederivatives, dibenzyl benzene derivatives, alkyl benzenes and biphenyl derivatives, optionally mixed with diluents or extenders such as kerosene, or from vegetable oils, optionally mixed with esters. Such vegetable oil-based systems are disclosed in our European Patent Applications Nos. 520639A, 573210A and 593192A.

The colour developer material used may be an acid clay, e.g. as described in U.S. Pat. No. 3,753,761; a phenolic resin, e.g. as described in U.S. Pat. No. 3,672,935 or No. 4,612,254; or an organic acid or metal salt thereof, e.g. as described in U.S. Pat. No. 3,024,927, European Patent Application Nos. 275107A, 503443A or 521474A, or German Offenlegungsschrift No. 4110354A.

Other red or near-red developing chromogenic materials which can be used instead of or in addition to the magenta chromogenic material just referred to include 2-methyl-6-N-ethyl-N-(4-methylphenyl) aminofluoran (Example 1 of British Patent No. 1374049); and 3-diethylamino-7-chloro-6-methylfluoran. Chromogenic materials developing hues other than red or near-red can alternatively or additionally be used, for example 3,3-bis(4-dimethylaminophenyl)-6-dimethylaminophthalide (CVL); N-butylcarbazol-3-yl-bis (4-N-methyl-N-phenylaminophenyl) methane (disclosed in British Patent No. 1548059, Manufacturing Direction J and commercially available from Ciba-Geigy as PERGASCRIPT Blue SRB); and 3-N-cyclohexylamino-6-chlorofluoran (disclosed in British Patent No. 1211393, Example 1 and commercially available from Yamada Chemical Company, Japan as "Orange 100"). The aggregate effect of all the chromogenic materials used must of course not be such as to produce a blue or black developed colour.

Additional security features can be incorporated in the present pressure-sensitive copying material if desired, for example by dyeing the stilt material prior to use or by the inclusion of microcapsules containing coloured dyes. Both of these expedients produce a coating containing coloured specks visible with a hand lens. A further possibility is the inclusion of fluorescent pigment granulates as disclosed in European Patent No. 226367B.

The invention will now be illustrated by the following Example, in which all parts and percentages are by weight unless otherwise stated:

EXAMPLE 1

A chromogenic material solution was first made up. The solvent was a 2:1 weight ratio mixture of a di-isopropylnaphthalene blend and kerosene. The chromogenic materials used were a magenta-developing chromogenic material as referred to earlier, namely PERGASCRIPT Red I-6B, and a fluorescent chromogenic material of formula (II) above, present in concentrations of 2.0 and 0.5% respectively.

The chromogenic material solutions were encapsulated on a laboratory scale by means of a generally conventional gelatin coacervation encapsulation technique as disclosed in British Patent No. 870476, using carboxymethyl cellulose and vinylmethylether/maleic anhydride copolymer as anionic colloids. The finished microcapsule dispersion was formulated into a conventional microcapsule coating composition using a gelatinized starch binder and a mixture of ground cellulose fibre floc and wheatstarch granules for preventing premature microcapsule rupture. This coating composition was applied to the uncoated surface of commercially-available white 46 $gm^{-2}$ CF paper by means of a small-scale metering roll coater to produce CFB paper. The CF paper utilised acid-washed dioctahedral montmorillonite clay as the active colour developing ingredient.

Two sheets of the test CFB paper were then used with conventional CF paper to make up a 3-part business forms set (CFB-CFB-CF). The uppermost (CFB) sheet was then imaged using a dot-matrix printer. A clearly-legible red-orange copy image was obtained on the lowermost CFB sheet and on the CF sheet.

Two sheets of a control CFB paper were also used to make up a similar 3-part set, which was then imaged in the same way. The control CFB paper utilised microcapsules containing the magenta chromogenic material (2.0% concentration) without the fluorescent chromogenic material. A clearly legible magenta copy image was obtained on the lowermost CFB sheet and on the CF sheet.

The reverse microcapsule-coated surface of the test and control CFB sheets were each exposed to UV light from a portable battery-operated UV lamp. The test sheet showed a high level of fluorescence. The control sheet showed some fluorescence, probably due to the use of optical brightening agents in the base paper, but this fluorescence was much less than in the sheet according to the invention. The inclusion of the fluorescent chromogenic material therefore provides a security feature by means of which the authenticity of the paper can be verified.

The above procedure was repeated on a laboratory scale using a laboratory Meyer bar coater, but with commercially-available coloured 46 $gm^{-2}$ CF papers in place of the white CF paper and with commercially-available coloured black copy CFB paper as a control. A further repeat was carried out on a larger scale with the yellow CF paper using a larger, but still pilot-scale, metering roll coater. In all cases, the control coloured papers showed no significant fluorescence (optical brightening agents being substantially absent) and thus the contrast between the fluorescence obtained with the product according to the invention contrasted markedly with the lack of fluorescence of the control paper.

EXAMPLE 2

This illustrates the use of alternative image hue colours, namely yellow, green and purple.

Chromogenic material solutions were made up as follows:

(i) Yellow image hue

1% of fluorescent chromogenic material of formula (II) and 2% of Orange 100 in a 50:50 weight ratio mixture of a di-isopropylnaphthalene blend and kerosene.

(ii) Purple image hue 0.25% of fluorescent chromogenic material of formula (II), 1.5% of CVL, 1.1% of "PERGASCRIPT Blue SRB", and 2% of PERGASCRIPT Red I-6B in a 70:30 weight ratio mixture of a di-isopropylnaphthalene blend and kerosene.

(iii) Green image hue

1% of fluorescent chromogenic material of formula (III), 0.5% of CVL, and 0.34% of PERGASCRIPT Blue SRB, in a 70:30 weight ratio mixture of a di-isopropylnaphthalene blend and kerosene.

These solutions were separately encapsulated as described in Example 1, and coating compositions were made up from the resulting microcapsule dispersions, also as described in Example 1. The coating compositions were then applied to the uncoated surfaces of respective sheets of commercially-available yellow 46 $gm^{-2}$ CF paper by means of a laboratory Meyer bar coater at a target dry coatweight of ca. 5 $gm^{-2}$.

The microcapsule-coated surfaces of samples of each of the resulting papers were exposed in a dark box with a viewing window to a UV lamp switchable between emission of short and long wavelength UV light. The yellow and purple image hue products each produced an intense blue fluorescence with both short and long wavelength light, the latter giving the stronger fluorescence. The green image hue product produced a pink/blue fluorescence with both short and long wavelength light.

Samples of each of the papers were also used with conventional CF papers to make up pressure-sensitive copying couplets which were then block-imaged by means of a dot-matrix printer. The expected yellow, purple and green hues were obtained.

EXAMPLE 3

This illustrates the use of each of fluorescent chromogenic materials (III), (IV), (V) and (VI) in respective red image hue pressure-sensitive copying products. In each case, the fluorescent chromogenic material was used in combination with PERGASCRIPT Red I-6B. The solvent in each case was a 70:30 weight ratio mixture of a di-isopropylnaphthalene blend and kerosene. The concentrations of fluorescent chromogenic material and PERGASCRIPT Red I-6B were 0.75% and 3% respectively in each case. Each chromogenic material solution was encapsulated, formulated into a coating composition, and coated on to base paper as described in Example 2. The resulting papers were then assessed for fluorescence and image-generating capability as described in Example 2.

The paper containing fluorescent chromogenic material (III) gave an intense pink fluorescence under both short and long wavelength UV light. The remaining papers all produced a pale but readily discernible fluorescence under short wavelength UV light, but no fluorescence under long wavelength UV light.

All the papers produced strong red hues on dot-matrix block imaging.

I claim:

1. A method comprising detecting the fluorescence of a chromogenic material component of a pressure-sensitive copying material, wherein said pressure-sensitive copying material comprises a substrate carrying isolated droplets of an oil solution of the chromogenic material, said droplets being confined within respective pressure-rupturable barriers, and wherein said chromogenic material:

(a) develops a color other than blue or black on contact with a color developer in use of the copying material; and (b) comprises a component which is fluorescent, whereby the authenticity of the copying material can be verified by irradiation with ultra-violet light to produce fluorescence.

2. A method as claimed in claim 1 wherein the fluorescent component of the chromogenic material comprises a bis-quinazoline which generates a yellow or orange hue on colour development and has a structure within the general formula (I) shown below:

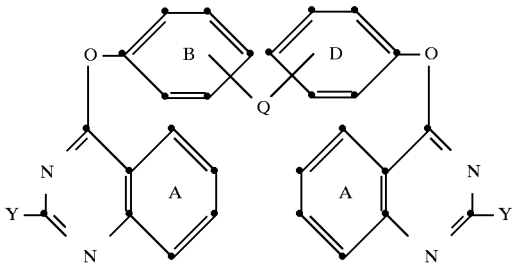

(I)

wherein

Q is a direct bond, an aliphatic or cycloaliphatic hydrocarbon radical containing not more than 8 carbon atoms, or is —CO—, —S— or —$SO_2$—, and Y is the radical of a couplable compound, and the rings A, B and D may each independently be unsubstituted or substituted by cyano, nitro, halogen, lower alkyl, phenyl, benzyl, lower alkoxy or lower alkoxycarbonyl.

3. A method as claimed in claim 2, wherein Y is the radical of a couplable N,N-disubstituted aniline or an N-substituted tetrahydroquinoline.

4. A method as claimed in claim 3, wherein the bis-quinazoline is of the formula (II) shown below:

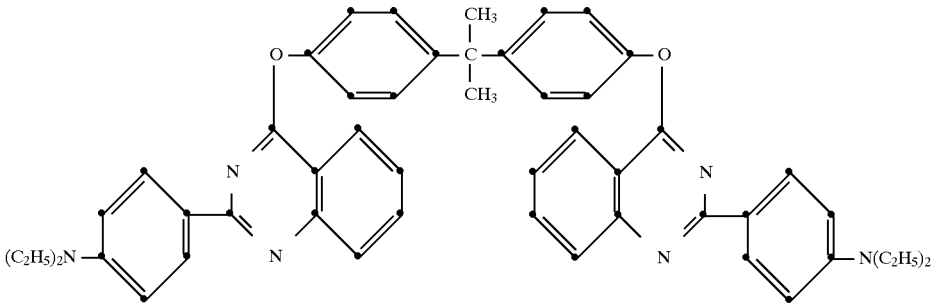

(II)

i.e. 2,2-bis(4-{2-[4-diethylaminophenyl]-quinazolin-4-yloxy}phenyl) propane.

5. A method as claimed in claim 1 wherein the fluorescent component of the chromogenic material is 1-(3-methoxy-4-dodecyloxyphenyl)-2-(2'-quinolyl) ethylene.

6. A method as claimed in claim 1, wherein the concentration of fluorescent chromogenic material in the oil solution is from 0.25to 1% by weight.

7. A method as claimed in claim 6 wherein the chromogenic material generating a red or magenta hue is 3,3-bis(1-n-octyl-2-methylindol-3-yl) phthalide.

8. A method as claimed in claim 1, wherein the chromogenic material also comprises a component which generates a red or magenta hue on colour development.

9. A method as claimed in claim 8, wherein the concentrations of the fluorescent compound and the red- or magenta-developing chromogenic material are from 0.25% to 1% and from 1 to 2.0% by weight respectively.

10. A method as claimed in claim 9, wherein the weight ratio of red- or magenta-developing chromogenic material to fluorescent chromogenic material is from about 4:1 to about 6:1.

11. A method as claimed in claim 1, wherein the substrate is coloured, rather than white, paper.

12. A method according to claim 1 comprising verifying the authenticity of a document comprising said pressure-sensitive copying material.

13. A method according to claim 1 comprising verifying the authenticity of a document of a business form set comprising a pressure-sensitive copying material, said method comprising detecting the fluorescence of a chromogenic material component of said pressure-sensitive copying material.

* * * * *